US006036068A

United States Patent [19]

Cartmell

[11] Patent Number: 6,036,068

[45] Date of Patent: Mar. 14, 2000

[54] RESTRAINING AND/OR RETAINING APPARATUS FOR PORTABLE DEVICES

[76] Inventor: Steven D. Cartmell, 2624 W. Ft. Worth Pl., Broken Arrow, Okla. 74012

[21] Appl. No.: 09/118,755

[22] Filed: Jul. 17, 1998

[51] Int. Cl.[7] ..... A45F 5/00

[52] U.S. Cl. ..... 224/258; 224/223; 224/625; 224/626; 224/660; 224/683

[58] Field of Search ..... 224/159, 191, 224/223, 625, 626, 908, 909, 257, 258, 600, 610, 623, 624, 660, 683

[56] References Cited

U.S. PATENT DOCUMENTS

| | | | |
|---|---|---|---|
| 611,692 | 10/1898 | Langdon | 224/223 |
| 3,326,430 | 6/1967 | Banks | 224/908 X |
| 3,326,432 | 6/1967 | Banks et al. . | |
| 3,526,347 | 9/1970 | Kuban | 224/909 X |
| 3,884,403 | 5/1975 | Brewer . | |
| 4,320,863 | 3/1982 | Lyer et al. | 224/908 X |
| 4,349,139 | 9/1982 | Oishi | 224/257 |
| 4,416,405 | 11/1983 | Caillouet | 224/257 |
| 4,556,159 | 12/1985 | Swain | 224/257 |
| 4,898,311 | 2/1990 | Boyer | 224/257 |
| 5,016,797 | 5/1991 | Rowledge | 224/257 |
| 5,195,666 | 3/1993 | Yamaguchi et al. | 224/159 |
| 5,307,967 | 5/1994 | Seals | 224/909 X |
| 5,320,261 | 6/1994 | Anderson | 224/194 |
| 5,360,149 | 11/1994 | Lucot | 224/257 |
| 5,370,288 | 12/1994 | Field | 224/223 |
| 5,662,252 | 9/1997 | Martin | 224/909 X |
| 5,738,256 | 4/1998 | Goff et al. | 224/909 X |

*Primary Examiner*—Gregory M. Vidovich

[57] ABSTRACT

A restraining and/or retaining apparatus 18 consisting of an elastic band 19 and retaining loops 21A, 21B for restraining and retaining multiple neck-suspended and/or unsuspended devices at the same time. The elastic band 19 wraps around the back and sides of the user and then encircles the neck strap, cord, lanyard or string 34 of a portable device 40 suspended at the chest or abdomen, and restricts its movement while walking, running, bending over or to the side. When the portable device 40 is used, the elasticity of the elastic band 19 allows it to be moved to any position from the chest to the face with little resistance and without detaching it. The retaining loops 21A, 21B hold and/or restrain other neck suspended or unsuspended devices at the same time for quick and convenient access.

4 Claims, 4 Drawing Sheets

RESTRAINING AND/OR RETAINING APPARATUS FOR PORTABLE DEVICES

BACKGROUND

1. Field of Invention

This invention relates to article carrying and restraining devices, specifically to an improved restaining device for articles suspended from the neck by a strap, cord, lanyard and/or string, or retaining articles that are not suspended.

2. Description of Prior Art

Several types of devices have been invented to hold instruments and articles against the front of the body to prevent swinging. The purpose was to improve user comfort and prevent damage due to collision. Most of them were designed so that the article being carried could be brought to face level without detaching it. One such device, U.S. Pat. No. 4,898,311, performs these functions. Unfortunately, the rubber tubing's poor elasticity allows the article to be held for only a few seconds before fatigue is experienced. Also, the length is not adjustable once cut and fastened. There are many exposed metal parts that create excessive noise for wildlife viewing. The tubing has the potential of disconnecting while stretched, and excessive movement is required to disconnect and reconnect the tubing to the binoculars while in the field Also, when this device is used for the first time it is difficult and time consuming to install the connections onto the binoculars. In addition, it is designed to be used only on devices that have a strap receptacle.

Other similar devices (U.S. Pat. No. 5,360,149) are available which are adjustable but with difficulty. They have to be removed for the adjustment to be made. This inconvenience may require it to be put on and taken off many times to achieve the proper fit. Also, whenever a change is made in the amount of clothing worn, it has to be readjusted to fit properly again.

Lastly, no device found is designed to hold more than one article at a time, nor designed to hold unsuspended articles.

SUMMARY

In accordance with the present invention, a restraining and/or retaining apparatus comprises an adjustable elongated elastic band with retaining loops connected to its side, and various fasteners that are covered by removable cloth sleeves.

OBJECTS AND ADVANTAGES

Accordingly, several objects and advantages of the present invention are as follows:

(a) It prevents excessive lateral, forward, or diagonal motion of the device(s) being carried.

(b) The elastic band has enough elasticity to allow the article to be easily and quickly moved from the front torso to eye level with minimal resistance and to be held for a long period.

(c) The length or tension can be adjusted quickly without removing it, and when the amount of clothing is increased or decreased it can be quickly readjusted.

(d) It attaches directly to the neck-strap, cord, lanyard, or string of the article being carried whether the article is binoculars, camera, whistle, game call, range finder, global positioning system, or any other device.

(e) It prevents unncessary noise by keeping the binoculars, camera, game call, etc. from colliding with other devices being carried in hand such as a gun while walking, running or bending over, (f) It has very few hard parts to prevent excessive noise when contact is made with other objects.

(g) It has removable cloth sleeves that can be slid over hard parts to prevent contact with other objects which insures that excessive noise is eliminated.

(h) There is no noise created when the suspended or unsuspended devices are moved from the torso to eye level.

(i) The two main holding loops are held in place by a button, clamp, and/or slide fastener preventing accidental disconnection.

(j) It can restrain and/or retain more than one suspended or unsuspended device at the same time.

(k) It can be used by a person of almost any size or age.

(l) It is quickly installed the first time it is used and is quickly removed and reinstalled on other devices.

Further objects and advantages of this invention are that it can be used by right or left banded individuals by simply turning it over, and it takes up little space when stored.

DRAWING FIGURES

In the drawing, closely related figures have the same number but different alphabetic suffices.

REFERENCE NUMERALS IN DRAWINGS

Figure 1:
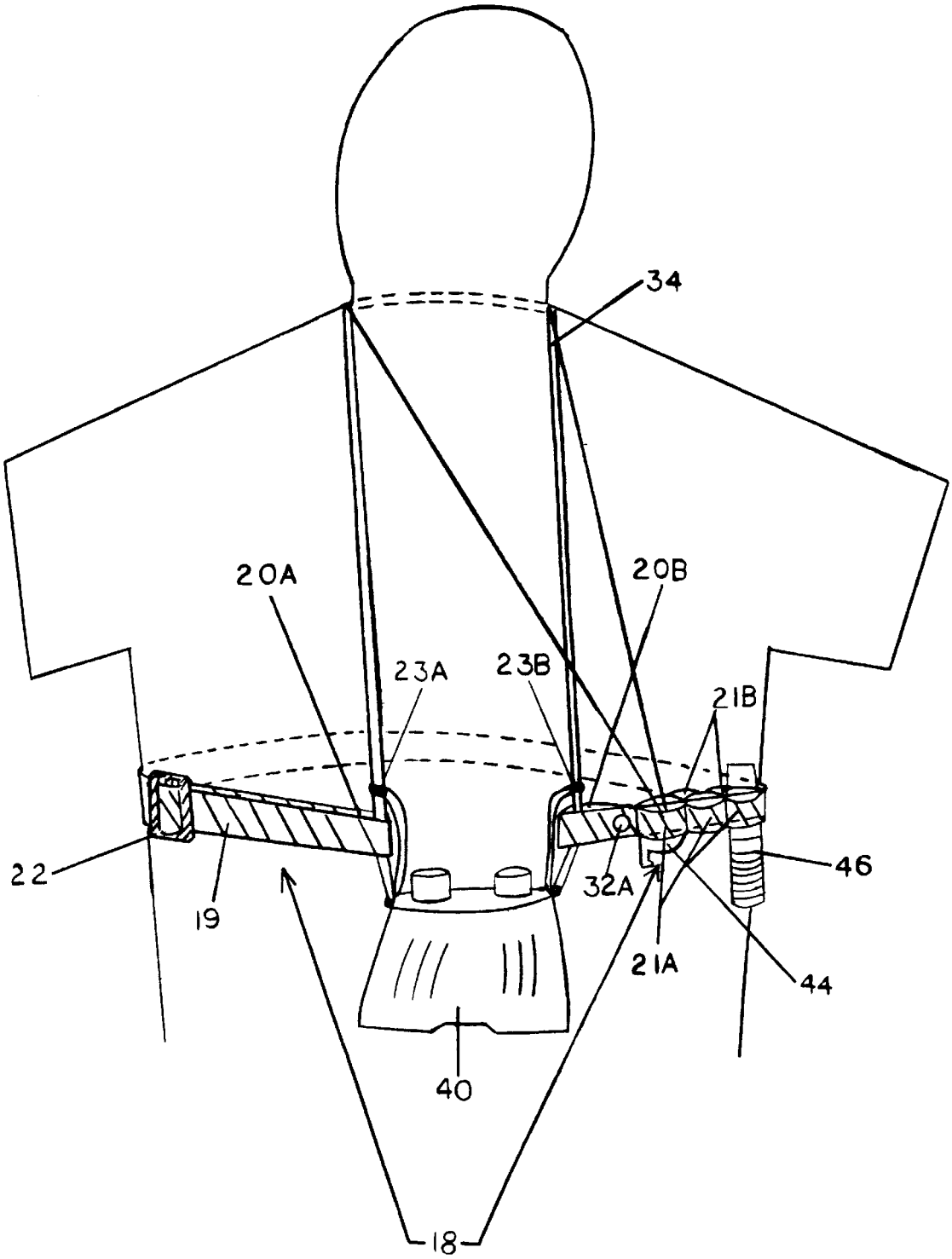
FIG. 1 is a perspective view of my invention shown supporting a suspended primary portable device (binoculars), a second suspended device (whistle) and another unsuspended secondary device (grunt call with a holding clip).
Figure 2:
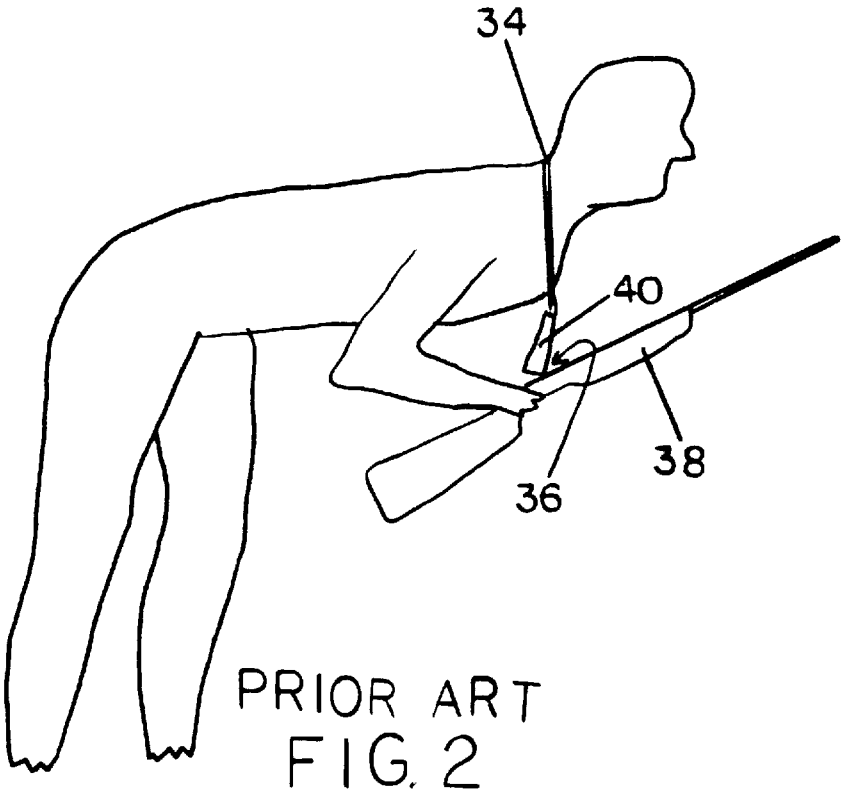
PRIOR ART FIG. 2
FIG. 2 shows how the primary device (binoculars), without my invention attached, collides with a hand held device (rifle) as a person bends over.

18 restraining and/or retaining apparatus
19 elastic band (primary flat elongated body)
20A restraining loop for neckstrap of primary device
20B restraining loop for neckstrap of primary device
21A retaining loop for secondary devices (portion of second flat elongated body)
21B retaining loop for secondary devices (portion of second flat elongated body)
22 single bar slide fastener
23A neckstrap loop connection
23B neckstrap loop connection
32A tie tack button
32B tie tack button
33A cloth sleeve
33B cloth sleeve
34 neckstrap, cord, lanyard or string of primary device
36 point of contact between unrestrained optical device and rifle, creating noise

38 rifle
40 primary suspended device (binoculars)
44 secondary suspended device (whistle with string)
46 secondary unsuspended device (grunt call with clip)
48 retaining apparatus without connection to a primary device but rather to itself via a loose leaf ring
50 loose leaf ring (connecting ring)
52A hook and loop fastener
52B hook and loop fastener
53 center bar of single bar slide fastener

DESCRIPTION AND OPERATION-FIGS. 1 to 6

FIG. 1 shows a perspective view of a basic version of a restraining and/or retaining apparatus 18 attached to a neckstrap 34 of binoculars 40. The preferred main embodiment of this invention is a primary single length of elongated elastic material forming a band 19 that wraps around the back and sides of the torso of the user. The elastic band 19 can be of various widths but is shown as 2.56 centimeters wide. The primary elastic band 19 can stretch at least twice its contracted length and is composed of polyester and rubber, cotton and rubber or any elastic material. The elastic material allows the user to be able to move the primary suspended device 40 from the torso to the face without excessive muscle strain. The end of the elastic band 19 on the user's left side is looped back on itself 20B encircling the neckstrap 34 and connected to itself with a tie tack button 32A. The primary elastic band 19 can encircle the neckstrap 34 above or below the neckstrap loop connections 23A, 23B. The tie tack button 32A gives the user the flexibility of a custom fit. The length of the restraining apparatus 18 is cut to fit the torso circumference of the user and then the tie tack button 32A is installed The use of tie tack buttons 32A, 32B also allows the restraining apparatus 18 to be easily removed and reinstalled on other devices. In FIG. 1, on the right hand side of the user, a loop 20A is fastened with a single bar slide 22. The single bar slide 22 is connected to the end of the elastic band 19 by looping the band around the center bar of the single bar slide 22 and attaching it to itself with a tie tack button 32B. The single bar slide 22 allows the user to quickly and easily adjust the length of the restraining apparatus 18, and the length can be adjusted without removing it. The restraining and/or retaining apparatus 18 can be loosened by moving the single bar slide 22 forward to the point of which the amount of tension is negligible when the binoculars 40 are held at face level. The restraining and/or retaining apparatus 18 can be tightened by sliding the single bar slide 22 backwards to the point that the primary suspended device 40 can be held very tightly against the body when walking or running. The tie tack button 32A and single bar slide 22 and tie tack button 32B are covered with cloth sleeves 33A, 33B to prevent them from touching external hard surfaces preventing noise. The cloth sleeves 33A,33B can either be slid to one side to gain access to slide 22 or tie tack buttons 32A, 32B, or the cloth sleeves can be removed by disconnecting hook and loop fasteners 52A, 52B. Next to the tie tack button 32A, there are multiple retaining loops 21A, 21B used for holding whistles 44, game calls 46, a compass, film canister or other items. The secondary suspended and/or unsuspended devices may have a lanyard, clip or be free of any holding device. In the preferred embodiment shown, the retaining loops 21A are sewn to both sides of the primary elastic band 19 by attaching a second band on top of the primary one 19. More retaining loops 21B can be attached to retaining loops 21A by attaching more bands on top of the secondary one. With attachments that are removable or adjustable, the loop can be changed in size for accommodating different sizes of devices. The retaining loops 21A, 21B provide quick, convenient access to multiple articles needed in the field FIG. 2 demonstrates how an optical device 40 collides with a gun 38 when the person bends over. This creates unnecessary noise which could alert wildlife being pursued. The restraining apparatus 18 holds the primary suspended device 40 against the body, therefore, preventing it from moving forward or loosely and colliding with the weapon in hand.

Figure 3:
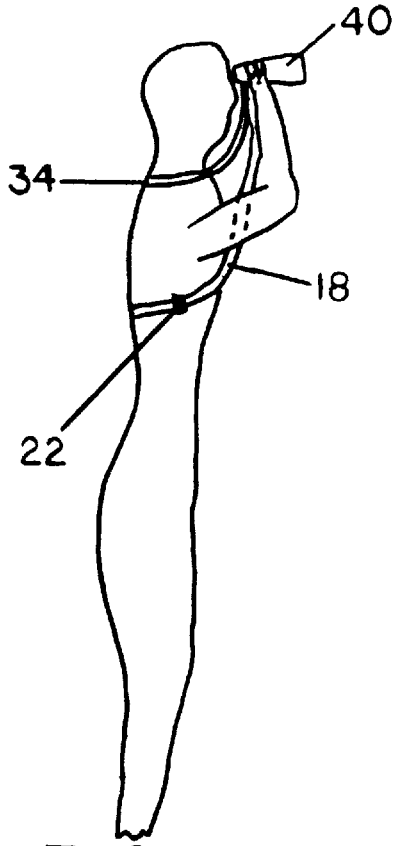
FIG. 3 shows the present invention in use, demonstrating how the elasticity of the band allows a primary device (binoculars) to be held at eye level.

FIG. 3 demonstrates that when the optical device 40 is moved from the torso to the face, the elasticity of the band stretches to accommodate this movement.

Figure 4:
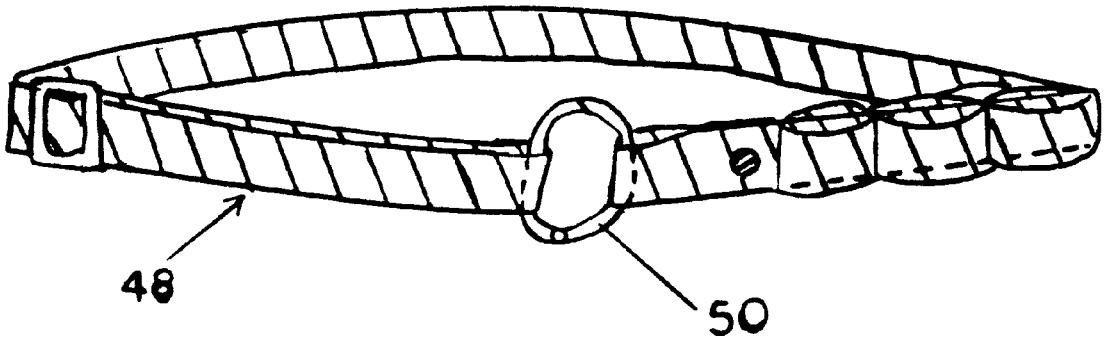
FIG. 4 shows the restraining loops encircling a loose leaf ring and creating a connection for use without the primary device.

FIG. 4 demonstrates how the restraining and/or retaining apparatus 18 can be used solely as a retaining apparatus for holding devices without being connected to a primary suspended device. Also, two restraining and/or retaining apparatus 18 could be used at the same time. One could be used as a restraining and retaining apparatus, and the other as a retaining apparatus alone which would allow more articles to be carried. FIG. 4 shows the two restraining loops 20A, 20B encircling a loose leaf ring (connecting ring) 50. There are many types of devices that can be used instead of a loose leaf ring to connect the two loops 20A, 20B including a string. The most practical connection is to encircle one loop 20B into the other 20A.

Figure 5:
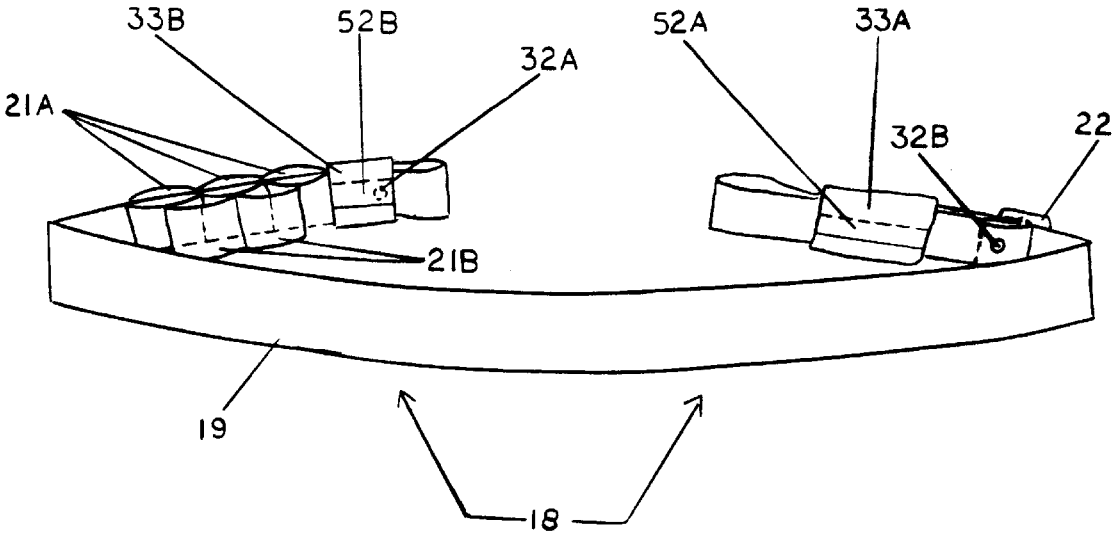
FIG. 5 is a back view of the restraining apparatus showing the cloth sleeves with their hook and loop fasteners. It also shows a back view of the single bar slide fastener and its connection to the elastic band with a tie tack button.
Figure 6:
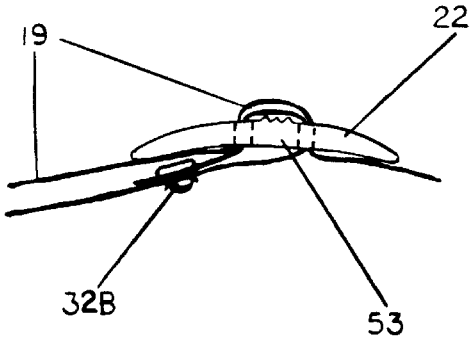
FIG. 6 is an enlarged top view of the single bar slide fastener. This view shows the connection to the elastic band with the tie tack button.

FIG. 5 shows the preferred embodiment with cloth sleeves 33A, 33B with hook and loop fasteners 52A, 52B that cover the slide 22 and tie tack buttons 32A, 32B. Also, FIG. 5 demonstrates how a cloth sleeve 33A can be slid to one side instead of removing it to allow access to the single bar slide fastener 22 and tie tack button 32B. FIG. 6 shows an enlarged top view of the single bar slide 22. The elastic band 19 is first slid next to the concave side of the slide 22 and then pushed through the rectangular opening next to a bar 53 through to the convex side. At this position, the primary elastic band 19 is slid over the bar 53 and wove back through a rectangular opening on the opposite side of the bar 53 back to the concave side encircling the bar 53. The loose end of the elastic band 19 is then pressed against the portion of the elastic band 19 on the other side of the bar 53 encircling it. They are then connected together with a tie tack button 32B. The opposite end of the band 19 is wrapped around the neckstrap 34 in FIG. 1 encircling it and then pushed through rectangular openings of the single bar slide 22 parallel the other end of the elastic band 19. It is then wrapped around the back side of the torso of the user and looped around the other end of the neck strap 34 encircling it. This end of the elastic band 19 is then pressed against itself and connected with a tie tack button 32A. At this point, the restraining and/or retaining apparatus 18 is probably too long. The user then removes the tie tack button 32B under the single bar slide 22 pushes the single bar slide backward to the desired position to allow for excess clothing and cuts the elastic band 19 in two pieces with scissors. The end piece that is now not connected to the restraining apparatus 18 is discarded. At this point, the end of the shortened elastic band 19 is once again woven around the bar 53 of the single bar slide 22 exactly as described before then it is pressed against itself and fastened with a tie tack button 32B. At this point, while the restraining and/or retaining apparatus is worn the single bar slide 22 can be slid forward to expand its circumference or decrease tension, or it can be slid backward to constrict its circumference or increase tension.

CONCLUSIONS, RAMIFICATIONS, AND SCOPE OF INVENTION

Accordingly, the reader will see that this invention is quick, quiet and easy to use. It can hold multiple articles. It allows the user to be comfortable by preventing lateral, forward or diagonal motion and collision with his/her body. It prevents unnecessary noise by preventing collision with other objects, by having few metallic or hard plastic parts, and by covering hard parts with a cloth sleeve. It can be removed and reattached to the same or other portable devices quickly and easily. One restraining and/or retaining apparatus can be used for left and right hand users. It takes up little space when stored. It is very economical to manufacture. It can be used by persons of almost any size and age.

Although, the description above contains many specificities, these should not be construed as limiting the scope of the invention but as merely providing illustrations of some of the presently preferred embodiments of this invention. For example, the restraining and/or retaining apparatus could be made of any type of elastic material including the product polyurethane. It could have pockets instead of retaining loops or a combination of both. Also, it could have more retaining loops created by attaching one or more strips of elastic band material that overlap one another and the original retaining loops. It could be made of a nonelastic material. It could have a type of slide fastener that moves up and down the neck strap or similar article. Also, there are many variations of connecting devices that could be used to connect the ends of the elastic band or restraining loops of the restaining and/or retaining apparatus to the neckstrap, cord, lanyard or string of the suspended article. In addition, these same connecting devices could be used to connect the ends of the elastic band or restraining loops of the retaining apparatus. There are many variations and combinations of the types of hardware that could be used such as slides, slide fasteners, buckles, snaps, adjusters, buttons, fasteners, hook and loop fasteners, buttons and button holes, buttons and button loops, clip fasteners, clips, etc. that can be used in place of the ones mentioned. The restraining and/or retaining apparatus and hardware could be any color or design. The elastic band could be any size, shape, width, or thickness and have any level of flexibility.

Accordingly, the scope of the invention should be determined by the embodiment(s) illustrated and by the appended claims and their legal equivalency.

I claim:

1. A restraining apparatus for securing a primary portable device suspended about the neck of a person, the portable device being suspended by a suspension device comprising one of a strap, cord, lanyard, or string and having opposite ends securable to the portable device, said retaining apparatus comprising:

a) a first, primary, flat elongated body of flexible material having opposite first and second ends adapted to wrap around the back and the sides of the person, said first end of said material adapted to extend around the first end of the suspension device and folding back on itself to define a first loop, said second end of said material adapted to extend around the second end of the suspension device and folding back on itself to define a second loop;

b) said first loop of said material including a first fastener for securing said first loop of said material about the first end of the suspension device;

c) said second loop of said material including a second fastener for securing said second loop of said material about the second end of the suspension device, said second fastener allowing adjustment of the size of said second loop of said material permitting said flexible material to be adjustable in size;

d) a second flexible material connected to and overlapping said primary material in such a way as to create a plurality of loops for holding additional devices therein;

e) a third flexible material connected to and overlapping said second flexible material in such a way as to create an additional plurality of loops for holding additional devices; and f) cloth sleeves provided on said primary material for respectively covering said first and second fasteners as a means to prevent contact with external objects to limit noise.

2. The restraining apparatus as defined in claim 1 wherein said first material is elastic.

3. A restraining apparatus for use about the mid-torso of a person, said restraining apparatus comprising:

a) a connecting device;

b) a first, primary, flat elongated body of flexible material having opposite first and second ends adapted to wrap around the back and the sides of the person, said first end of said material passing through said connecting device and folding back on itself to define a first loop, said second end of said material passing through the connecting device and folding back on itself to define a second loop;

c) said first loop of said material including a first fastener for securing said first loop of said material about said connecting device;

d) said second loop of said material including a second fastener for securing said second loop of said material about said connecting device, said second fastener allowing adjustment of the size of said second loop of said material permitting said flexible material to be adjustable in size;

e) a second flexible material connected to and overlapping said primary material in such a way as to create a plurality of loops for holding additional devices therein;

f) a third flexible material connected to and overlapping said second flexible material in such a way as to create an additional plurality of loops for holding additional devices; and g) cloth sleeves provided on said primary material for respectively covering said first and second fasteners as a means to prevent contact with external objects to limit noise.

4. The restraining apparatus as defined in claim 3 wherein said first material is elastic.

* * * * *